United States Patent [19]

Meussdoerffer et al.

[11] 4,138,466

[45] Feb. 6, 1979

[54] PRODUCING CHROMATE SUBSTANTIALLY FREE OF VANADIUM

[75] Inventors: Johann N. Meussdoerffer; Wolfgang Bockelmann, both of Leverkusen; Hans Niederpriim, Monheim, all of Fed. Rep. of Germany

[73] Assignee: Bayer Aktiengesellschaft, Leverkusen, Fed. Rep. of Germany

[21] Appl. No.: 841,234

[22] Filed: Oct. 11, 1977

[30] Foreign Application Priority Data

Oct. 30, 1976 [DE] Fed. Rep. of Germany ..... 2650012

[51] Int. Cl.[2] ..... C01G 37/14; C01G 31/00; C01G 23/00

[52] U.S. Cl. ..... 423/61; 423/53; 423/62; 423/71; 423/85

[58] Field of Search ..... 423/53, 56, 58, 61, 423/62, 71, 85

[56] References Cited

U.S. PATENT DOCUMENTS

| | | | |
|---|---|---|---|
| 1,760,788 | 5/1930 | Specketer et al. | 423/61 |
| 1,911,396 | 5/1933 | Siklatvalla et al. | 423/71 |
| 2,045,836 | 6/1936 | Coffelt | 423/71 |
| 2,496,993 | 2/1950 | Goda | 423/71 |
| 2,583,591 | 1/1952 | Perrin et al. | 423/58 |
| 2,839,359 | 6/1958 | Dunning | 423/53 |
| 3,856,512 | 12/1974 | Palmer et al. | 423/61 |
| 3,933,972 | 1/1976 | Bauwens et al. | 423/58 |

FOREIGN PATENT DOCUMENTS

| | | | |
|---|---|---|---|
| 45-14416 | 5/1970 | Japan | 423/61 |

*Primary Examiner*—Herbert T. Carter

*Attorney, Agent, or Firm*—Sprung, Felfe, Horn, Lynch & Kramer

[57] ABSTRACT

In the recovery of chromium from a residue containing chromate and vanadate, by oxidative decomposition of a chromium and vanadium-containing ore in the presence of an alkali at temperatures of about 600 to 1200° C., and leaching such residue with water, the improvement which comprises adding titanium dioxide to the residue and heating, whereby upon leaching the chromium enters the water while the vanadium is substantially left in the residue.

8 Claims, No Drawings

PRODUCING CHROMATE SUBSTANTIALLY FREE OF VANADIUM

The present invention relates to a process for working up residues from a conventional process for decomposition of chromium ore by means of alkaline oxidative decomposition in the presence of materials containing a high proportion of titanium dioxide.

Ores which, despite being prepared by the most varied methods, contain specific proportions of impurities in the form of vanadium ores are used for conventional chemical chromium ore decomposition (cf. Gmelins Handbuch der anorganischen Chemie, vanadium 48, 8th edition, section A/1, 1968, pages 25, 31). During the alkaline oxidative decomposition of chromium ores of this type, the impurities are also decomposed; thus almost all of the vanadium is converted to water soluble vanadate when the charge is leached into the chromate lye (loc. cit. page 199). However, for some purposes, a complete separation of the vanadium from the chromate lye is desired. Separation of this type is based, for example, on the sparing solubility of certain vanadates, for example, lead vanadate or calcium vanadate. In order to achieve separation of this type, calcium salts or salts of heavy metals were formerly added to the chromate lyes and the sparingly soluble vanadate salt was precipitated.

Depending upon the place of origin of the decomposed ore and upon the particular chromium ore decomposition process used, the chromate lyes contain very different quantities of vanadate. In order to simplify the process of continuous separation, the quantity of precipitant which is introduced is often adapted to the higher content of the vanadate which might be contained in the lye. In order to precipitate as much as possible of the vanadate, a considerable excess of precipitant is often used. By following this method of precipitation, therefore, a considerable quantity of sparingly soluble chromate is also simultaneously precipitated.

However, the chromates separated together with the vanadate in this way cause a considerable loss in yield for the entire process and a considerable outlay is also required for treating them and rendering them harmless in order to be depositable.

The object of the present invention is, therefore, to find a process for increasing the yield of a conventional process for the decomposition of chromium ores by working up the residues and for simultaneously producing a depositable chrome-free residue.

The present invention therefore relates to a process for working up residues containing chromate and vanadate by alkaline oxidative decomposition at temperatures of about 600° to 1200° C., which is characterized in that materials containing titanium dioxide are added to the residue and the resulting mixture is heated.

The present invention enables the residues containing chromate and vanadate to be worked up relatively simply by means of substantially quantitative separation of all of the chromium in the form of water soluble alkali chromate, so that the largest proportion of the undesired vanadium remains in the insoluble residue. According to microprobe investigations into the working up of calcium chromate mixtures and vanadate mixtures as described, calcium is present as unleachable calcium titanate, $CaTiO_3$, and vanadium as highly annealed, sparingly soluble calcium vanadate, $Ca_3(VO_4)_2$, and with sufficient quantities of alkali, the chromium present is converted quantitatively into water soluble chromate according to this process.

The process according to the invention is described below with reference to residues containing calcium chromate and calcium vanadate. The embodiments, however, are applicable to those residues which contain, instead of or in addition to calcium, those metal ions which form sparingly soluble precipitates together with chromate and vanadate ions.

According to the present invention, the sediment formed by adding calcium compounds during the separation of vanadium, optionally after drying, is decomposed by oxidation in the presence of an alkali at temperatures of about 600° to about 1200° C. Sodium hydroxide and/or soda, optionally also the corresponding potassium compounds, are preferably used as the alkali, but any alkali metal oxide, hydroxide and/or carbonate may equally be used. The alkali is generally introduced in a substantially stoichiometric quantity, based on the total quantity of chromium present in the residue, for the formation of alkali chromate, but a small excess has no initial effect on the process. The decomposition is carried out by oxidation, that is, either in the presence of air and/or in the presence of those substances which can eliminate oxygen.

The material containing $TiO_2$ is also added to this decomposition mixture during, after or preferably before the decomposition in a quantity which is sufficient to combine all the calcium from the calcium chromate as insoluble calcium titanate. The material containing $TiO_2$ is therefore added in an almost stoichiometric quantity, based on the total calcium content present, less the quantity which is required for the formation of calcium vanadate — corresponding to the vanadium content of the residue to be processed. An excess of $TiO_2$ has the effect of attacking the calcium vanadate present, which results in an increased leachable proportion of vanadium; on the other hand, a deficit of $TiO_2$ gives rise to a reduced chromate yield.

The term "materials containing titanium dioxide" includes titanium dioxide itself, brookite, anatase, and rutile, as well as alkali titanate and those materials which contain a high proportion of titanium dioxide, but no iron, for example partially hydrated $TiO_2$ sediments.

The mixture is subsequently heated. If the materials containing $TiO_2$ are introduced before or even during decomposition, then, in this case, the decomposition temperature is equal to the heating temperature. However, if the materials containing $TiO_2$ are introduced once the decomposition has finished, then the mixture must be heated for a longer period to temperatures of about 500° C. to 1300° C.

The quantities of calcium, vanadium or of all the chromium which is contained in the residue, may be determined very easily, for example, by means of a laboratory experiment. In this way the theoretically required quantities of alkali or material containing titanium dioxide, calculated as titanium dioxide, which must be added may be easily calculated.

After the subsequent reaction, the decomposed mixture, the so-called clinker, is leached in the usual manner. Water as well as wash water from chromate production or other solutions which already contain chromium (VI) may be used as the leaching agent. During this leaching, all of the chromium present in the residue is converted substantially quantitatively to alkali chromate in solution.

Therefore, by means of the process according to the invention, it is possible to decompose the chromium, all of which is present in the residue in an oxidized state and to remove it from the residue by means of leaching. Moreover, this leads to an outstanding yield, if this working up process is carried out in conjunction with a conventional chromium ore decomposition process.

The process according to the invention is described in more detail with the aid of the following examples:

EXAMPLE 1

100 parts of a dried residue containing calcium chromate and vanadate having a total chromium content of 20.6% calculated as $Cr_2O_3$, 21.7% of CaO and 7.2% of $V_2O_5$ were mixed with 21.7 parts of NaOH and 31 parts of $TiO_2$ and roasted for two hours at 1150° C. in the presence of air. After leaching with water, the clinker obtained did not contain any chromium either in the 3-valent or 6-valent form, but did contain all of the calcium as well as 80% of the originally available vanadium in the form of insoluble compounds; all of the chromium was present in the lye as alkali chromate.

EXAMPLE 2

100 parts of the above-mentioned calcium chromate/-vanadate sediment were reacted this time with 31.6 parts of soda and 21.5 parts of $TiO_2$ analogously to Example 1. The alkali chromate solution formed from the clinker after leaching with water contained the total quantity of chromium from the vanadate sediment; 85.1% of all of the vanadium was found in the leached residue; calcium was also quantitatively present in the residue as insoluble component.

It will be appeciated that the instant specification and examples are set forth by way of illustration and not limitation, and that various modifications and changes may be made without departing from the spirit and scope of the present invention.

What is claimed is:

1. In the recovery of chromium from a residue containing calcium, chromate and vanadate, by oxidative decomposition of said residue in the presence of an alkali compound at temperatures of about 600° to 1200° C., and leaching such residue with water, the improvement which comprises adding titanium dioxide to the residue before or during decomposition and heating, the titanium dioxide being added in almost stoichiometric quantity to form calcium titanate based on the total calcium content less the quantity of calcium required to form calcium vanadate, whereby upon leaching the chromium enters the water while the calcium, vanadium and titanium are substantially left in the residue.

2. A process according to claim 1, wherein the alkali compound is at least one alkali metal carbonate, alkali metal hydroxide and/or alkali metal oxide.

3. A process according to claim 1, wherein the alkali compound is added in almost stoichiometric quantity based on the total chromium content of the residue.

4. A process according to claim 1, wherein the oxidative decomposition is carried out in the presence of atmospheric oxygen.

5. A process according to claim 1, wherein an oxidizing substance capable of eliminating oxygen is employed in the oxidative decomposition.

6. A process according to claim 1, wherein the titanium dioxide is added in the form of titanium dioxide per se, brookite, rutile, anatase, sodium titanate or a material which contains a high proportion of titanium dioxide but substantially no iron.

7. A process according to claim 1, wherein the substantially chromium-free residue obtained is leached with water or an aqueous solution containing chromium (VI), the mass is filtered, and the filtrate is forwarded to the leaching step of the oxidative decomposition residue.

8. A process according to claim 7, wherein before the oxidative decomposition the titanium dioxide is added in the form of titanium dioxide per se, brookite, rutile, anatase, sodium titanate or a material which contains a high proportion of titanium dioxide but substantially no iron, wherein the alkali is at least one alkali metal carbonate, alkali metal hydroxide or alkali metal oxide and is added in almost stoichiometric quantity based on the total chromium content of the residue, and the oxidative decomposition is effected in the presence of at least one of atmospheric oxygen and an oxidizing substance capable of eliminating oxygen.

* * * * *

UNITED STATES PATENT AND TRADEMARK OFFICE

CERTIFICATE OF CORRECTION

PATENT NO. : 4,138,466

DATED : February 6, 1979

INVENTOR(S) : Meussdoerffer et al

It is certified that error appears in the above-identified patent and that said Letters Patent are hereby corrected as shown below:

| | |
|---|---|
| Title Page Inventors: | Delete "Niederpriim" and insert --Niederprüm--. |

Signed and Sealed this

*Fourth* Day of *December 1979*

[SEAL]

*Attest:*

SIDNEY A. DIAMOND

*Attesting Officer*

*Commissioner of Patents and Trademarks*